US010101009B1

(12) United States Patent
Martin

(10) Patent No.: US 10,101,009 B1
(45) Date of Patent: Oct. 16, 2018

(54) DEVICE TO ILLUMINATE UV ENERGY VIA A REFLECTIVE MATERIAL AND LIGHT ABSORBING MATERIAL

(71) Applicant: Stacey Watkins Martin, Cresson, TX (US)

(72) Inventor: Stacey Watkins Martin, Cresson, TX (US)

( * ) Notice: Subject to any disclaimer, the term of this patent is extended or adjusted under 35 U.S.C. 154(b) by 55 days.

(21) Appl. No.: 15/188,038

(22) Filed: Jun. 21, 2016

Related U.S. Application Data

(60) Provisional application No. 62/188,291, filed on Jul. 2, 2015.

(51) Int. Cl.

| | |
|---|---|
| ***F21V 13/08*** | (2006.01) |
| ***F21V 17/10*** | (2006.01) |
| ***F21V 9/30*** | (2018.01) |
| *F21W 121/00* | (2006.01) |

(52) U.S. Cl.
CPC ..... *F21V 13/08* (2013.01); *F21V 9/30* (2018.02); *F21V 17/101* (2013.01); *F21W 2121/00* (2013.01)

(58) Field of Classification Search
CPC ..... F21W 2121/00; F21W 2121/02; F21W 2121/023; F21W 2121/027; F21W 2121/04; F21W 2121/043; F21W 2121/047; F21W 2121/06; F21W 2121/08; F21W 2121/10; F21V 9/32; F21V 13/08
See application file for complete search history.

(56) References Cited

U.S. PATENT DOCUMENTS

| | | | | |
|---|---|---|---|---|
| 5,415,911 | A * | 5/1995 | Zampa | B32B 37/12 359/529 |
| 8,877,326 | B1 * | 11/2014 | Postrozny | B32B 27/08 428/195.1 |
| 9,896,020 | B2 * | 2/2018 | Dellock | F21S 43/33 |
| 2012/0118772 | A1 * | 5/2012 | Ellis-Brown | G06F 1/1628 206/320 |

* cited by examiner

*Primary Examiner* — Robert J May
(74) *Attorney, Agent, or Firm* — Eldredge Law Firm, LLC; Richard Eldredge; Beth Felix

(57) ABSTRACT

A decorative structure includes a contoured base having a top surface; an adhesive layer applied to the top surface; a reflective material secured to the adhesive layer; a resin composed of a phosphorescent pigment material and applied to the reflective material; and a plurality of non-transparent objects bonded to the resin.

1 Claim, 4 Drawing Sheets

DEVICE TO ILLUMINATE UV ENERGY VIA A REFLECTIVE MATERIAL AND LIGHT ABSORBING MATERIAL

BACKGROUND

1. Field of the Invention

The present invention relates generally to art, and more specifically to a system and method to illuminate art.

2. Description of Related Art

Art such as paintings for hanging on the wall is well known. For example, FIG. 1 depicts a simplified front view of a conventional painting 101 of an object 105 drawn on a canvas 107 or other suitable medium and secured with a frame 103. The painting 101 is pleasing for viewing during the day, but as commonly known, the painting 101 is not easily viewed during the night without an outside source illuminating thereupon.

Accordingly, one problem commonly associated with painting 101 is the limited use during night or in dark locations where an outside light source is needed for illumination. Another problem commonly associated with painting 101 is the necessary canvas 107 for painting thereupon.

Although great strides have been made in the area of painting and other types of art pieces, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
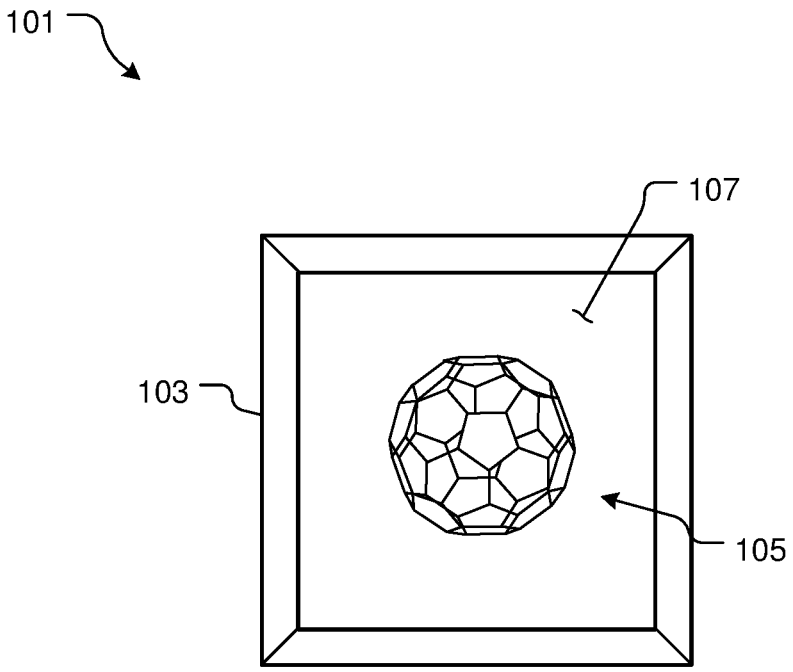
FIG. 1 (Prior Art)
FIG. 1 is a simplified schematic of a conventional piece of art.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional pieces of art. Specifically, the system and method of the present application provides means to view the pieces of art during night and/or in the dark. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
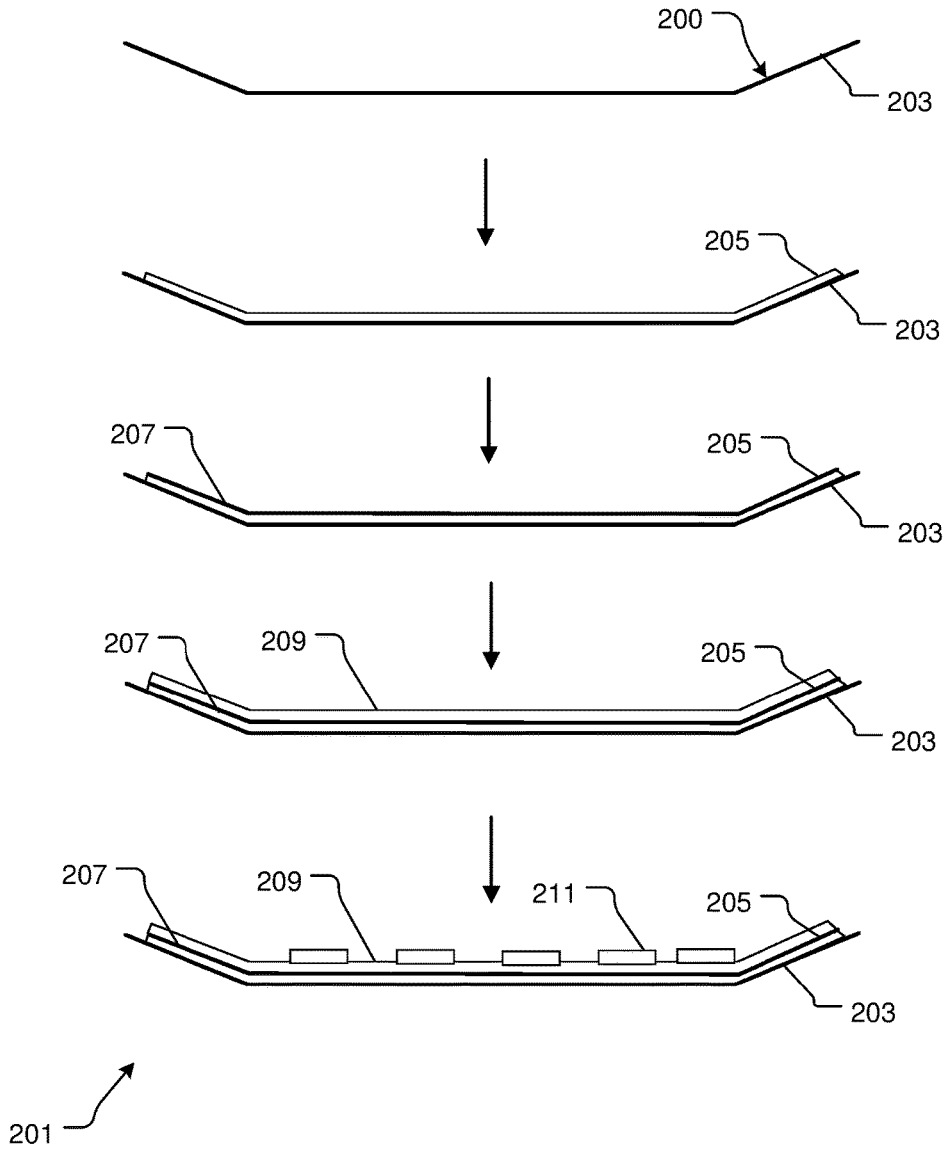
FIG. 2 is a simplified side schematic of a piece of art in accordance with a preferred embodiment of the present application.

Referring now to the drawings wherein like reference characters identify corresponding or similar elements throughout the several views, FIG. 2 depicts simplified side schematic of a system 201 in accordance with a preferred embodiment of the present application. It will be appreciated that system 201 overcomes one of more of the above-listed problems commonly associated with the conventional pieces of art, for example, painting 101.

In the contemplated embodiment, system 201 includes one or more of a base 203 configured to provide structural rigidity and support to the components of system 201 placed thereupon. It will be appreciated that base 203 could be composed of any desired material, including wood, metal, composites, elastomeric materials, and the like. The base could also be composed of a reflective material configured to illuminated in the dark conditions. Although base 203 is shown in the exemplary configuration, it will be appreciated that other geometric shapes and sizes are also contemplated in alternative embodiments. Accordingly, base 203 could take the form of a circular, rectangular, multiple edged, and other geometric shapes and sizes in alternative embodiments.

During assembly of system 201, an adhesive material 205 is applied to a top surface 200 of base 203. A reflective material 207 is secured to base 203 via adhesive and is configured to capture and illuminate light in the dark conditions. This feature is achieved by either manufacturing the reflective material to illuminate and/or to reflect the light from an illuminating material placed thereupon.

A resin 209 is applied to the reflective material 207 and preferable includes a colored phosphorescent pigment disposed therein for different light absorbing and illumination appearances. For example, the phosphorescent pigment could be any desired color or composed of material that allows more or less transparency. In one contemplated embodiment, the resin could be composed of an epoxy material; however, other types of resins are also contemplated in alternative embodiments.

An optional feature includes placing one or more objects 211 in the resin 209 impregnated with phosphorescent pigment for refracting the illumination from material 207 and/or to provide aesthetically pleasing appearances.

One of the unique features believed characteristic of the present system 201 is the ability to illuminate ultraviolet (UV) energy via a reflective material and UV light absorbing material. The aesthetically pleasing illumination is further enhanced by adding phosphorescent pigment to the resin and by adding objects to reflect and/or refract the light.

Figure 3:
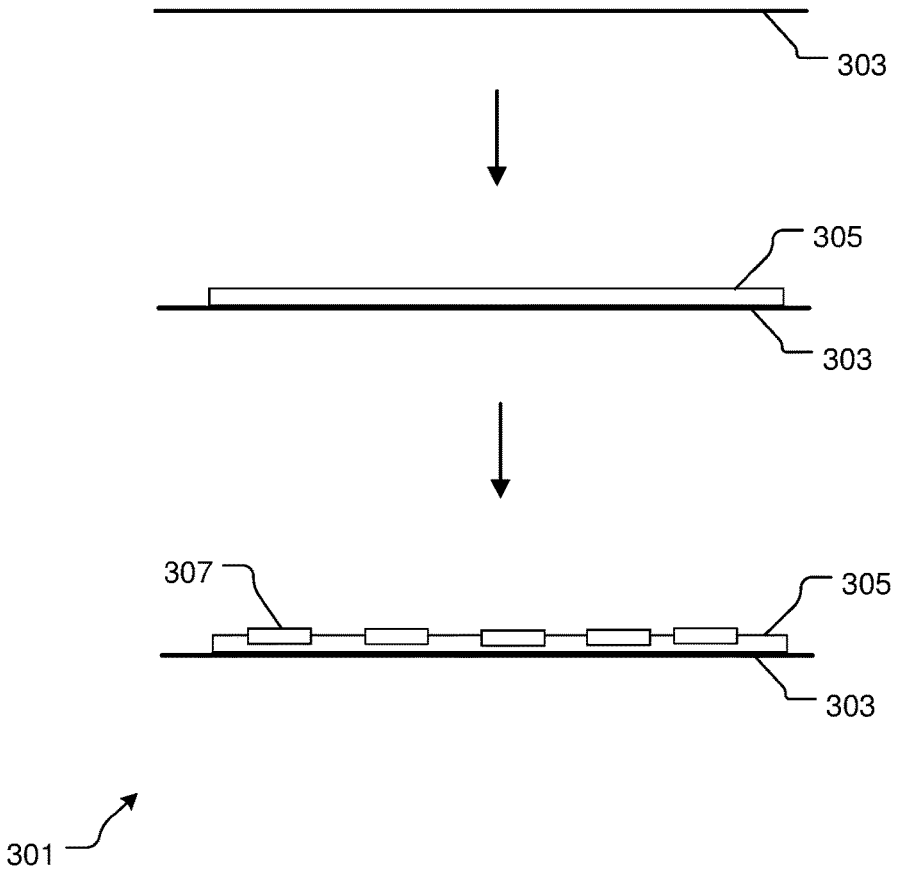
FIG. 3 is a simplified side schematic of a piece of art in accordance with an alternative embodiment of the present application.

As shown in FIG. 3, it will be appreciated that the systems discussed herein do not require the use of a base 203. For example, FIG. 3 depicts a system 301 substantially similar in form and function to system 201; however, in this embodiment, system 301 does not include a base.

The method to form system 301 includes using a non-stick liner 303 and applying a resin 305 impregnated with phosphorescent pigment thereupon. It will be appreciated that resin 305 is the same as resin 209 and could include a phosphorescent pigment disposed therein. Also, system 301 is further provided with one or more objects 307 secured to the resin 305.

Accordingly, in the exemplary embodiment, system 301 is composed of a light illuminating pigmentation resin with a phosphorescent pigment and objects disposed therein. The system 301 could thus conform to any desired shape, e.g., spherical, rectangular, and the like, that the resin is placed thereupon.

Figure 4:
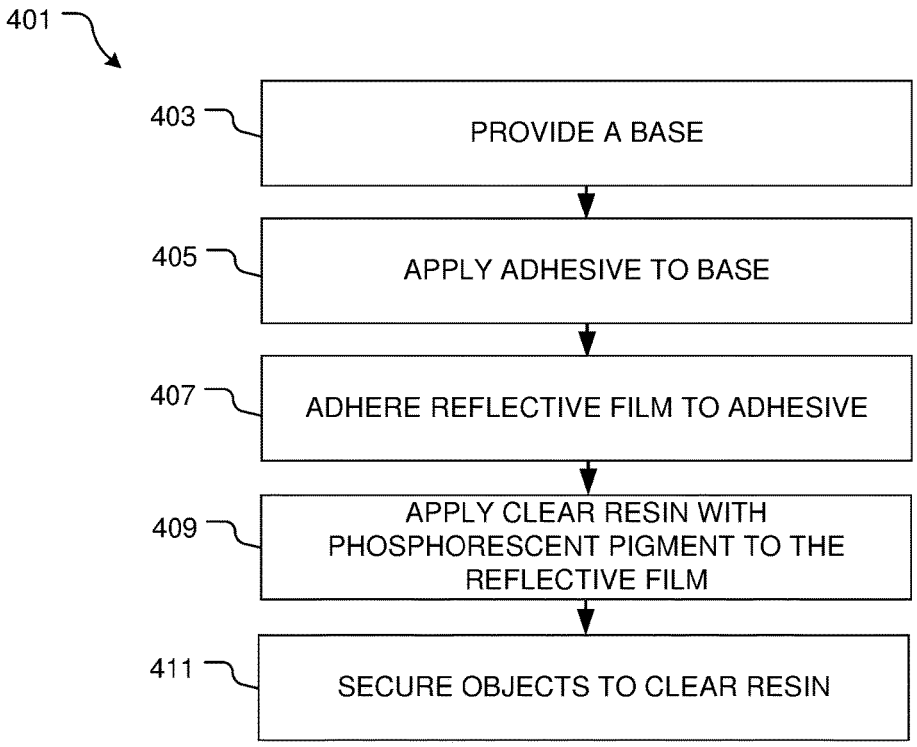
FIGS. 4 and 5 are flowcharts depicting the processes of forming the pieces of art of respective FIGS. 2 and 3.
Figure 5:
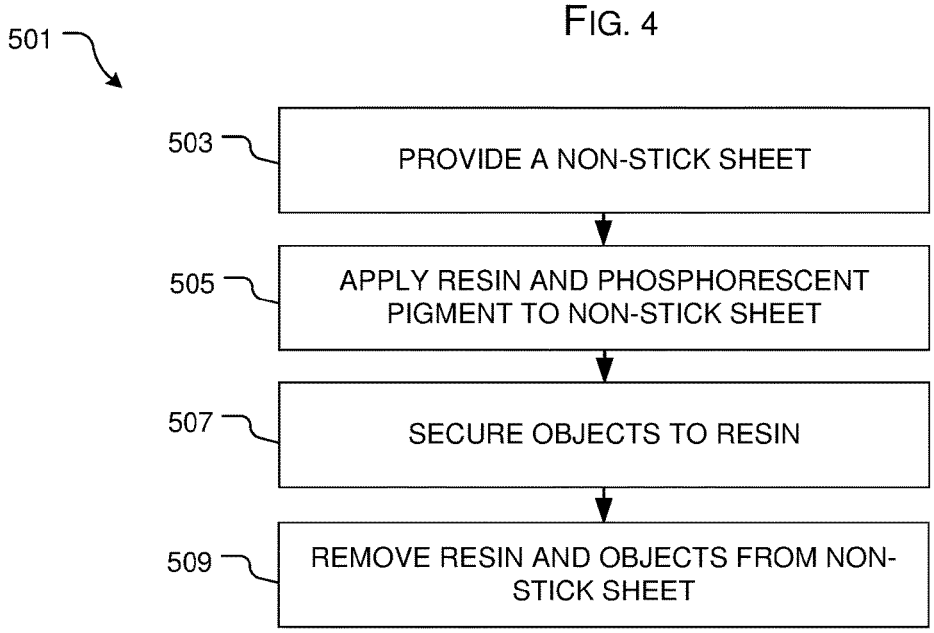

Referring now to FIGS. 4 and 5, simplified flowcharts depict the methods of use of respective systems 201 and 301. As shown in FIG. 4, flowchart 401 includes the process of providing a base and applying an adhesive to the base, as depicted in boxes 403, 405. Thereafter, a reflective layer is applied to the adhesive and a resin with phosphorescent pigment is applied to the reflective layer, as depicted with boxes 407, 409. Finally, one or more objects are placed in the resin, as depicted in box 411.

In FIG. 5, flowchart 501 depicts that process of manufacturing system 301, including the steps of providing a sheet of non-stick material, as depicted in box 503. It will be appreciated that the non-stick material could be placed on any geometric structure (not shown) such that the resin placed thereupon takes the form of the geometric structure. Next, the phosphorescent resin and objects are placed on the non-stick liner and thereafter removed after the resin is cured, as depicted in boxes 505, 507, and 509.

Although not shown in detail, it will be appreciated that one or more of the objects discussed above could be secured to the base and extend at a distance relative to the base and the resin and pigment disposed therebetween. Accordingly, in this embodiment, the resin illuminates the object in a backlit fashion. Such features are further enhances with holes extending through the object.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A decorative structure, comprising:

a contoured base having a top surface;

an adhesive layer applied to the top surface;

a reflective material secured to the adhesive layer;

a resin composed of a phosphorescent pigment material and applied to the reflective material, wherein the resin completely covers the reflective material, wherein the reflective material is sandwiched between the resin and the adhesive layer;

a plurality of non-transparent objects impregnated within the resin and extending past a top surface of the resin, wherein the resin is disposed between the plurality of non-transparent objects and the reflective material;

wherein the reflective material is configured to reflect light through the resin; and wherein the plurality of non-transparent objects is configured to block the light, thereby being illuminated in a backlit fashion via the reflective material.

* * * * *